United States Patent [19]

McNamee, Sr. et al.

[11] 4,352,535

[45] Oct. 5, 1982

[54] ELECTRICAL CONNECTOR

[75] Inventors: James W. McNamee, Sr.; Daniel N. Kosareo, both of Warren, Ohio

[73] Assignee: General Motors Corporation, Detroit, Mich.

[21] Appl. No.: 163,817

[22] Filed: Jun. 27, 1980

[51] Int. Cl.[3] ..... H01R 13/639

[52] U.S. Cl. ..... 339/75 MP; 339/176 MP

[58] Field of Search ..... 339/17 CF, 75 MP, 176 MP, 339/75 M; 174/52 FP

[56] References Cited

U.S. PATENT DOCUMENTS

| | | | |
|---|---|---|---|
| 3,408,612 | 10/1968 | Bute et al. | 339/17 |
| 3,573,617 | 4/1971 | Randolph et al. | 339/17 CF |
| 3,701,077 | 10/1972 | Kelly, Jr. | 339/17 CF |
| 3,710,299 | 1/1973 | Weisenburger | 339/17 CF |
| 3,753,211 | 8/1973 | Pauza et al. | 339/75 MP |
| 3,910,664 | 10/1975 | Pauza et al. | 339/17 CF |
| 3,999,827 | 12/1976 | Hutchison et al. | 339/17 CF |
| 4,066,325 | 1/1978 | Pearce, Jr. et al. | 339/176 MP |
| 4,089,575 | 5/1978 | Grabbe | 339/17 CF |
| 4,306,761 | 12/1981 | Ress, Jr. | 339/252 R |

*Primary Examiner*—John McQuade
*Attorney, Agent, or Firm*—F. J. Fodale

[57] ABSTRACT

An electrical connector for connecting a DIP and a wiring harness comprising a socket, terminals and a cover. The DIP has two sets of tabs which project from opposite sides of an insulated block and which are folded over onto the top and bottom surfaces of the block respectively. The DIP is disposed in a longitudinal slot at one end of the socket which is between two rows of terminal cavities. A terminal in each cavity is attached to a lead of the wiring harness and has a flexible contact bow engaging one of the tabs of the DIP. The cover is mounted over the slotted end of the socket to retain the DIP.

5 Claims, 11 Drawing Figures

ELECTRICAL CONNECTOR

This invention relates generally to electrical connectors and, more particularly, to an electrical connector for an electronic component of the type known commercially as a "dual-in-line package" or "DIP".

Semiconductor-type circuits, such as integrated circuits, "MSI" and "LSI" circuits, and hybrid circuits are commonly packaged in an insulated block with a plurality of thin parallel leads or tabs emerging from the block and connected to the appropriate component of the circuitry within. When the package has two sets of leads or tabs emerging from opposite sides of the insulated block, it is known as a "dual-in-line package" or "DIP".

An example of an electrical connector for a DIP is shown in U.S. Pat. No. 3,701,077 granted to Cornelius J. Kelly, Jr. on Oct. 24, 1972. The patent shows a socket 30 which receives a DIP 10 and which is adapted to be secured to a circuit board or the like.

In the past, it has been conventional practice to connect a DIP to a wiring harness through the intermediary of a printed circuit board. That is, the DIP is plugged in a socket attached to a printed circuit board, such as in the aforesaid Kelly patent, and the wiring harness in turn is connected to the printed circuit board by a printed circuit board connector such as the connector shown in the U.S. Pat. No. 4,066,325 granted to Warren Pearce, Jr. and Andrew Russo, Jr. on Jan. 3, 1978.

In its boardest aspects, the object of this invention is to provide an electrical connector for connecting a DIP directly to a wiring harness thereby eliminating the need for an intermediary printed circuit board.

Another object of the invention is to provide such a connector which is adapted for automotive use and which utilizes existing or conventional components as much as possible.

The invention also contemplates a unique adaptation of a DIP resulting in a compact design especially suitable for plugging into a socket attached to an automotive wiring harness.

Another feature of the invention is that the DIP interfaces with terminals of the type which are conventionally used in automotive wiring harnesses.

Still another feature of the invention is the use of a spring cover on the socket to retain the DIP in the socket and improve electrical contact between the terminals and the DIP contact tabs.

Other objects and features of the invention will become apparent to those skilled in the art as the disclosure is made in the following detailed description of a preferred embodiment of the invention as illustrated in the accompanying sheets of drawing in which.

Figure 1:
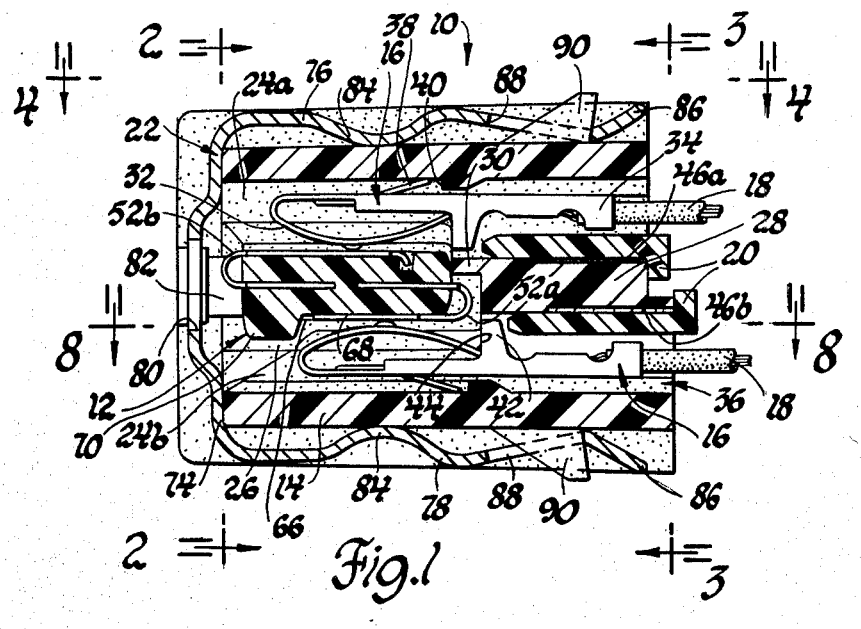
FIG. 1 is a longitudinal section of an electrical connector in accordance with this invention.
Figure 2:
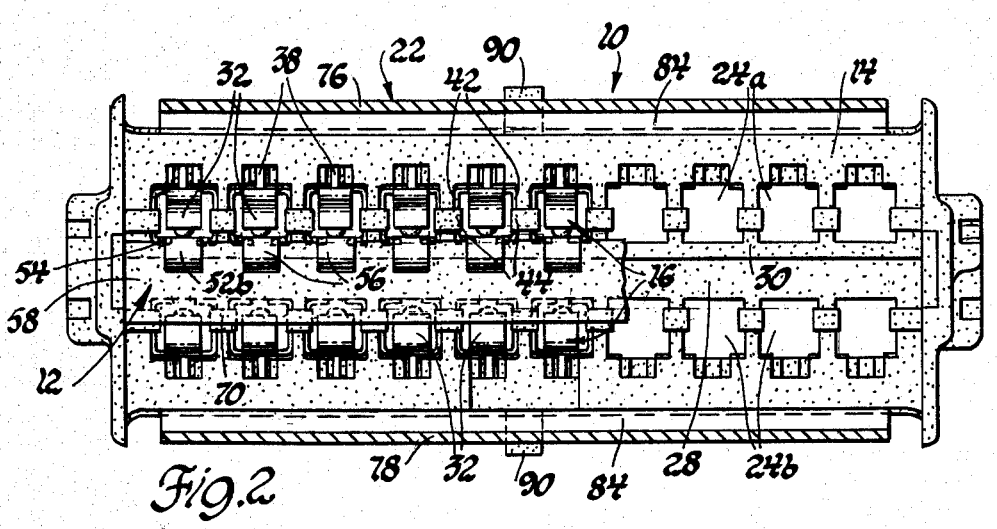
FIG. 2 is a section taken substantially along the line 2—2 of FIG. 1.
Figure 3:
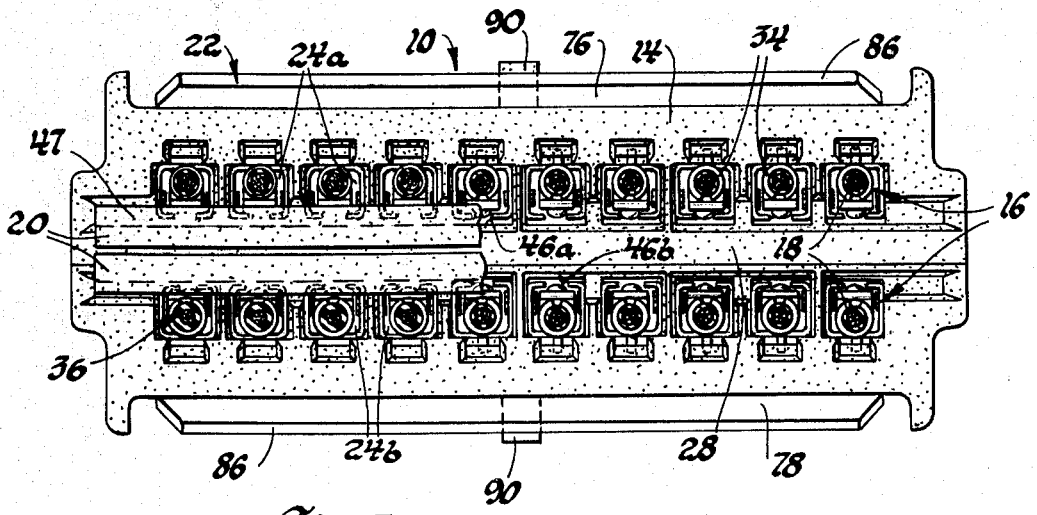
FIG. 3 is a section taken substantially along the line 3—3 of FIG. 1.
Figure 4:
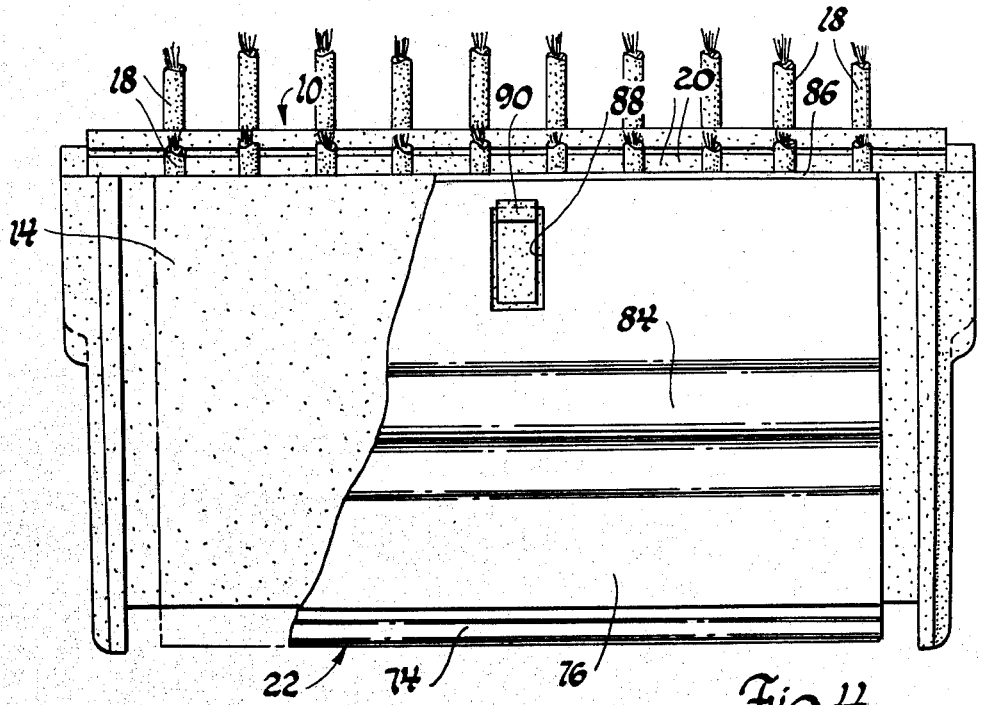
FIG. 4 is a top view of the connector taken substantially along the line 4—4 of FIG. 1.

Referring now to the drawing and particularly to FIG. 1, there is disclosed an electrical connector 10 for connecting a DIP 12 at the end of a wiring harness.

The electrical connector 10 comprises a molded plastic socket 14 containing two rows of sheet metal terminals 16 attached to the ends of leads 18 of a wiring harness (not shown); a pair of molded plastic lock bars 20 for locking the terminals 16 in the socket 14; and a tempered steel cover 22 which holds the DIP 12 in the socket 14.

The socket 14 has two vertically spaced rows of longitudinal terminal cavities 24*a* and 24*b* and an open transverse slot 26 at one longitudinal end. The slot 26 is located between the row of terminal cavities 24*a* and the row of terminal cavities 24*b* and intersects each of the terminal cavities.

The terminal cavities 24*a* and 24*b* are essentially mirror images of each other for receiving identical terminals 16 which engage opposite sides of the DIP 12. This is conventional practice in the case of printed circuit board connectors of the type shown in U.S. Pat. No. 4,066,325 granted to Warren Pearce, Jr. and Andrew Russo, Jr. on Jan. 3, 1978. The row of terminal cavities 24*a* (and the terminals 16 retained therein), however, is preferably offset in the longitudinal direction toward the slotted end of the socket 14 as shown in FIG. 1. This offset serves as an index means in conjunction with the shape of the DIP 12.

The socket 14 includes a transverse partition wall 28 between the row of terminal cavities 24*a* and the row of terminal cavities 24*b*. The partition wall 28 defines the inner end of the slot 26 and includes a longitudinally projecting abutment 30 which is vertically offset toward the row of terminal cavities 24*a*.

The terminals 16 each have a flexible contact bow 32 at one end engaging the DIP 12 and a crimp barrel 34 at the other end which attaches the terminal to one of the leads 18. One of the terminals 16 is inserted into each of the terminal cavities 24*a* and 24*b* through a cavity opening 36 at the lead end of the socket 14. Each terminal is retained in its respective cavity by a terminal latch tang 38 which engages a cavity latch shoulder 40. Over insertion is prevented by an intermediate box-shaped section 42 of the terminal which engages a pair of cavity stop shoulders 44.

Figure 6:
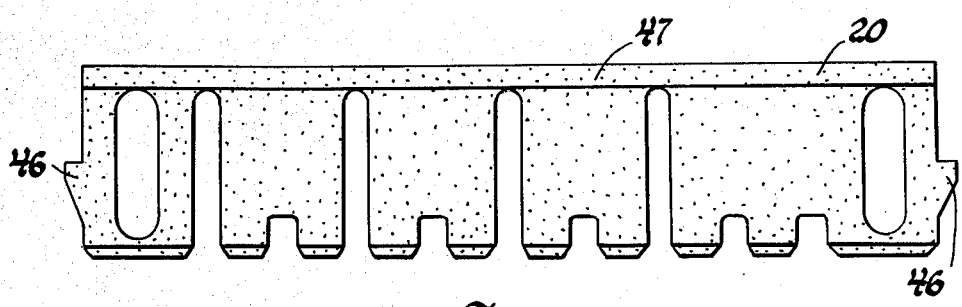
FIGS. 6 and 7 are top and side views, respectively, of a lock bar used in the connector shown in FIG. 1.
Figure 7:
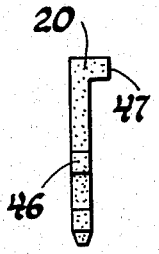
Figure 8:
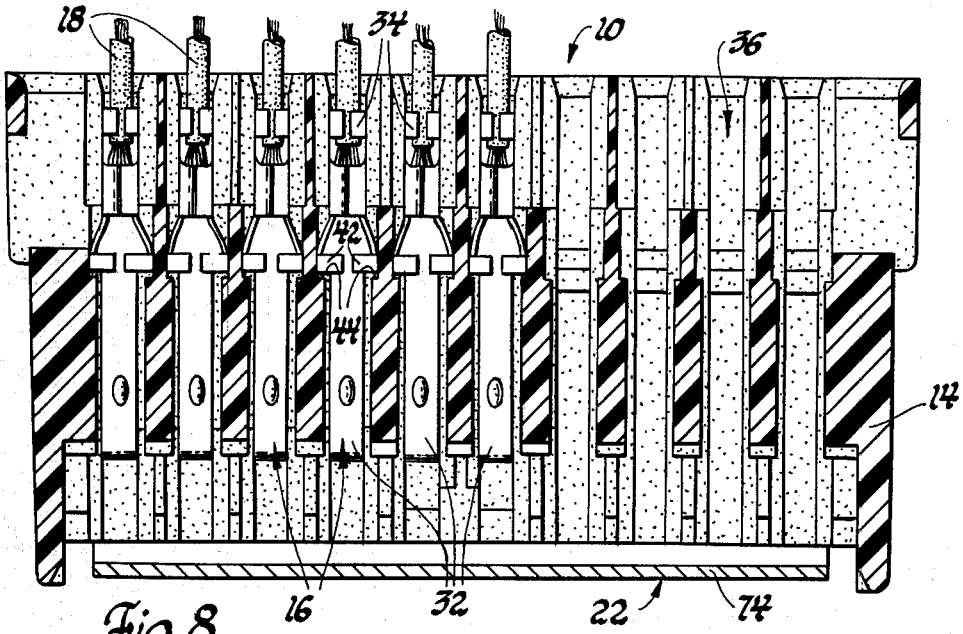
FIG. 8 is a section taken substantially along the line 8—8 of FIG. 1.

After the terminals 16 are individually retained in their respective cavities, each row of terminals is locked in the socket 14 as a group by one of the multi-fingered lock bars 20 shown in FIGS. 6 and 7. The lock bars 20 are inserted into slots 46*a* and 46*b* which traverse the rows of terminal cavities 24*a* and 24*b* respectively, at the lead end of the socket 14. When assembled, one of the lock bars 20 has a finger behind the box-shaped section 42 of each of the terminals 24*a*; the other lock bar has a finger behind the box-shaped section of each of the terminals 24*b*.

Figure 5:
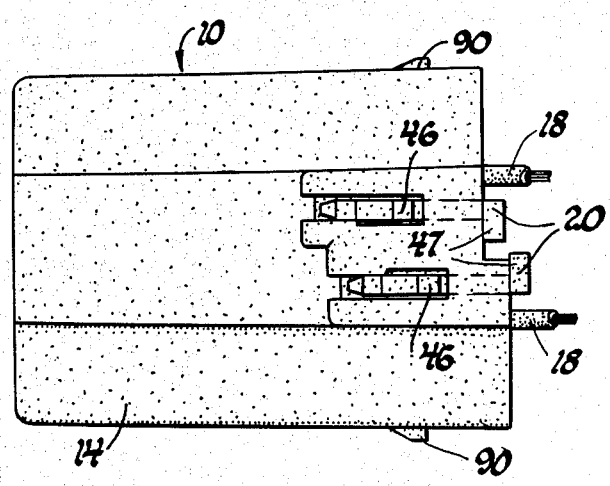
FIG. 5 is a side view of the connector shown in FIG. 4.

The lock bars 20 are retained in their respective slots by lock nibs 46 which engage side wall portions of the socket 14 as shown in FIG. 5. The lock bars 20 each have an end flange 47 to prevent over insertion.

The lock bar feature is similar to that shown in the aforementioned Pearce et al patent and is not, per se, a part of this invention. Likewise terminals 16, per se, are not a part of this invention. The particular terminals 16 illustrated in the drawing are produced by the assignee of this invention and conventionally used in automotive wiring harness connectors. The terminals are disclosed as known prior art in U.S. patent application Ser. No. 139,164, filed Apr. 11, 1980, now Pat. No. 4,306,761. However, other terminals of this general type may be used with coordinating modifications to the terminal cavities, such as the terminals illustrated in the patent application or the terminals illustrated in the aforementioned Pearce et al patent.

Figure 9:
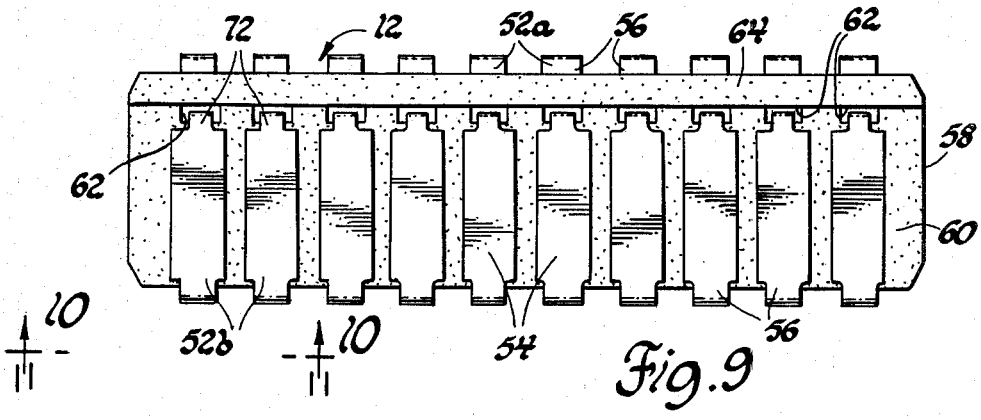
FIG. 9 is a top view of the DIP shown in FIG. 1.
Figure 11:
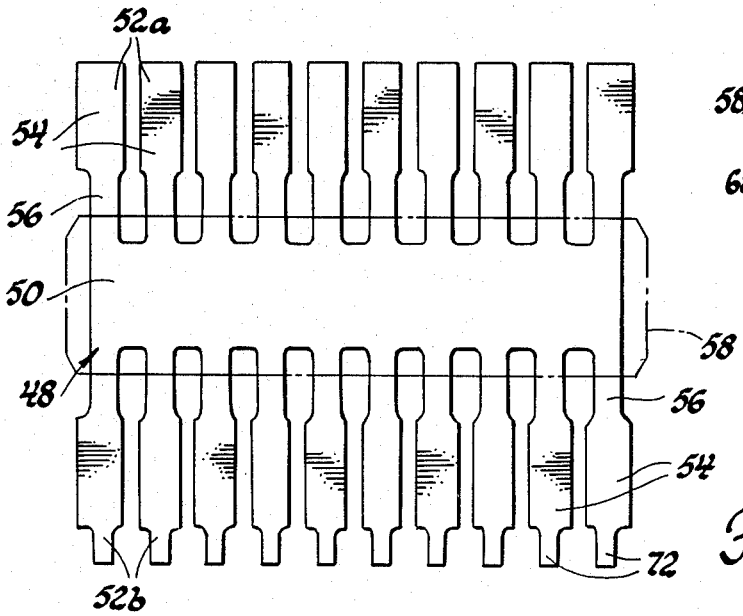
FIG. 11 is a plan view of a lead frame for the DIP shown in FIGS. 9 and 10.
Figure 10:
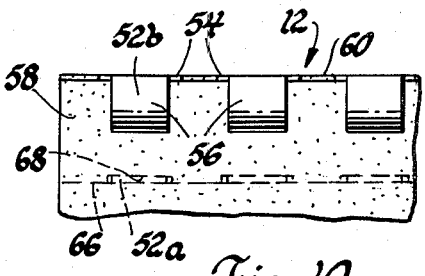
FIG. 10 is a view taken substantially along the line 10—10 of FIG. 9.

After the terminals 16 are locked in the socket 14, the socket 14 is ready to receive the DIP 12 which is shown in FIGS. 9, 10 and 11.

FIG. 11 shows a lead frame 48 stamped from flat sheet metal stock, usually a soft, tin plated brass having a thickness of about 0.25 mm. The frame 48 has a rectangular body 50 with two sets of tabs 52*a* and 52*b* projecting from the opposite longer sides of the body 50 respectively. The tabs are especially designed for this application. First, the tabs are reduced half the number normally used in standardized packages. This permits each of the tabs 52*a*, 52*b* to have wider than normal contact portions 54 for proper mating with conventional automotive type terminals. The wider contact portions 54 furthermore are connected to the body 50 by a narrow neck 56 to facilitate bending as will hereinafter more fully appear.

The lead frame 48 is combined with a semiconductor type circuit, such as an integrated circuit, "MSI" circuit, "LSI" circuit or hybrid circuit and packaged in a molded block 58 of insulating material, (shown in phantom in FIG. 11). When molded, the sets of thin parallel tabs 52*a*, 52*b* emerge from opposite sides of the block 58 and are connected to the appropriate component of the circuitry within the block 58. The body 50 of the lead frame 48 is suitably altered with cutouts during the process in view of the circuitry involved.

The specific circuitry involved and the manufacturing processes in molding the block 58 and altering the lead frame 48 is not important to an understanding of this invention. The shape of the block 58, however, is unique in many respects and so is the further processing of the DIP 12 after the intermediate stage represented in FIG. 11.

As shown in FIGS. 9 and 10, the top 60 of the block 58 has a set of recesses 62 near the side of the block from which the tabs 52*a* emerge, and a raised rib 64 between the recesses 62 and that side. The height of the rib 64 is equal to the thickness of the tabs 52*b* so that the rib 64 protects the tabs 52*b* and facilitates insertion of the DIP 12 into the socket 14. The bottom 66 of the block 58 has a set of longitudinal grooves 68 which extend from the side from which the tabs 52*a* emerge to a depending rib 70 at the opposite side. The depth of the rib 70 is considerably greater than the thickness of the tabs 52*a* as the rib 70 serves as an index means and as a means for removing the DIP 12 from the socket 14.

At the intermediate stage, the DIP 12 has two sets of parallel tabs 52*a*, 52*b* spaced apart from one another, with the tabs 52*a* and 52*b* emerging from opposite sides of the molded block 58 in a coplanar fashion.

The tabs 52*b* are reversely bent at their necks 56 so that their contact portions 54 lie on the top 60 of the block 58. The tabs 52*b* also have narrow tails 72 which are bent down into the recesses 62 to guard against the tabs 52*b* being pried up when the DIP 12 is inserted into the socket 14. The tabs 52*a* are also reversely bent at their necks 56 so that their contact portions 54 lie in the grooves 68 in the bottom of the block 58. The ends of these contact portions are protected by the depending rib 70.

The uniquely shaped DIP 12 is inserted into the slot 26 of the socket 14 as shown in FIG. 1; the rib 70 and offset row of cavities 24*b* cooperating as an index means to insure proper orientation of the DIP 12. The offset abutment 30 at the inner end of the slot 26 locates the DIP 12 in the longitudinal direction while providing space for the reversely bent necks 56 of the tabs 52*a*. After the DIP 12 is assembled in the socket 14, the cover 22 is attached to close the slotted end of the socket 14.

The cover 22 is a generally U-shaped sheet metal member of spring tempered steel, comprising a base 74 and spring legs 76 and 78. The base 74 has a central hole 80 and bent-in tabs 82 at its transverse edges. The tabs 82 engage the DIP 12 to retain it in the proper position in the slot 26 when the cover 22 is attached to the socket 14. Each of the spring legs 76 and 78 has an arcuate, depressed, transverse channel 84 near the base 74, a flared free end 86 and an aperture 88 adjacent the flared free end. The flared free ends 86 and apertures 88 cooperate with lock projections 90 of the socket 14 to secure the cover 22. The spacing between the channels 84 is slightly less than the height of the socket portion engaged by the channels 84, so that the cover 22 exerts a clamping force on the slotted end of the socket 14. This improves electrical contact between the terminals 16 and the DIP 12 and prevents bell-mouthing of the slot 26 after extended use.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector for connecting a DIP having an insulated block with first and second sets of substantially parallel circuitry tabs projecting from opposite respective sides thereof to a wiring harness comprising:

a DIP having first and second sets of tabs folded over onto the top and bottom surfaces of an insulated block respectively, a socket having a longitudinal slot at one end receiving the DIP, two rows of terminals in the socket disposed on opposite sides of the slot, each of said terminals being attached to a lead of a wiring harness and having a flexible contact engaging one of the tabs of the DIP, and a cover mounted over the one end of the socket to retain the DIP in the slot.

2. An electrical connector for connecting a DIP having an insulated block with first and second sets of substantially parallel circuitry tabs projecting from opposite respective sides thereof to a wiring harness comprising:

a DIP having first and second sets of tabs folded over onto the top and bottom surfaces of an insulated block respectively, a socket having two rows of terminal cavities and a slot at one end which is between the two rows of terminal cavities and which communicates with each of the terminal cavities, said DIP being disposed in said slot with its top and bottom surfaces each facing one of the rows of terminal cavities, a terminal disposed in each of the terminal cavities, each terminal being attached to a lead of a wiring harness at one end and having a flexible contact at an opposite end engaging one of the tabs of the DIP, and a cover mounted over the one end of the socket to retain the DIP in the slot.

3. An electrical connector for connecting a DIP having an insulated block with first and second sets of substantially parallel circuitry tabs projecting from opposite respective sides thereof to a wiring harness comprising:

a DIP having first and second sets of tabs folded over onto the top and bottom surfaces of an insulated block respectively, each of said tabs of said DIP having a reversely bent neck adjacent one of the sides of the insulated block and a wider contact portion lying on one of the top and bottom surfaces of the insulated block, a socket having two rows of terminal cavities and a slot at one end which is between the two rows of terminal cavities and which communicates with each of the terminal cavities, said DIP being disposed in said slot with its top and bottom surfaces each facing one of the rows of terminal cavities, a terminal disposed in each of the terminal cavities, each terminal being attached to a lead of the wiring harness at one end and having a flexible contact bow integrally attached at an opposite end engaging one of the contact portions of the DIP, and a cover mounted over the one of the socket to retain the DIP in the slot, said cover including spring legs which clamp the one end of the socket.

4. An electrical connector for connecting a DIP having an insulated block with first and second sets of substantially parallel circuitry tabs projecting from opposite respective sides thereof to a wiring harness comprising:

a DIP having first and second sets of tabs folded over onto the top and bottom surfaces of an insulated block respectively, a socket having two rows of longitudinal terminal cavities and a longitudinal slot at one end which is between the two rows of longitudinal terminal cavities and which communicates with each of the longitudinal terminal cavities, one of the rows of longitudinal terminal cavities being offset from the other in the longitudinal direction and said longitudinal slot having a projecting stop at its inner end which is offset toward one of the rows of the terminal cavities, said DIP being disposed in said slot with its top and bottom surfaces each facing one of the rows of the longitudinal terminal cavities and with one of its sides engaging the projecting stop, a terminal disposed in each of the terminal cavities, each terminal being attached to a lead of a wiring harness at one end and having a flexible contact at an opposite end engaging one of the tabs of the DIP, and a cover mounted over the end of the socket, said cover having portions engaging the other side of the DIP to retain the DIP in the longitudinal slot.

5. An electrical connector for connecting a DIP having an insulated block with first and second set of substantially parallel circuitry tabs projecting from opposite respective sides thereof to a wiring harness comprising:

a DIP having first and second sets of tabs folded over onto the top and bottom surfaces of an insulated block respectively, each of said tabs of said DIP having a reversely bent neck adjacent one of the sides of the insulated block and a wider contact portion lying on one of the top and bottom surfaces of the insulated block, a socket having two rows of longitudinal terminal cavities and a longitudinal slot at one end which is between the two rows of longitudinal terminal cavities and which communicates with each of the longitudinal terminal cavities, one of the rows of longitudinal terminal cavities being offset from the other in the longitudinal direction and said longitudinal slot having a projecting stop at its inner end which is offset toward one of the rows of the terminal cavities, said DIP being disposed in said slot with its top and bottom surfaces each facing one of the rows of the longitudinal terminal cavities and with one of its sides engaging the projecting stop, a terminal disposed in each of the terminal cavities, each terminal being attached to a lead of the wiring harness at one end and having a flexible contact bow integrally attached at an opposite end engaging one of the contact portions of the DIP, and a cover mounted over the end of the socket, said cover having tabs engaging the other side of the DIP to retain the DIP in the longitudinal slot and spring legs which clamp the one end of the socket at a location between the sides of the DIP.

* * * * *